US010930424B1

(12) United States Patent
Folker et al.

(10) Patent No.: US 10,930,424 B1
(45) Date of Patent: Feb. 23, 2021

(54) LOW PROFILE INDUCTOR

(71) Applicant: Universal Lighting Technologies, Inc., Madison, AL (US)

(72) Inventors: Donald Folker, Madison, AL (US); Mark Bauer, Laguna Vista, TX (US); John J. Dernovsek, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 720 days.

(21) Appl. No.: 15/679,563

(22) Filed: Aug. 17, 2017

Related U.S. Application Data

(60) Provisional application No. 62/383,827, filed on Sep. 6, 2016.

(51) Int. Cl.
*H01F 5/00* (2006.01)
*H01F 27/28* (2006.01)

(52) U.S. Cl.
CPC ..... *H01F 27/2804* (2013.01)

(58) Field of Classification Search
USPC ..... 336/200
See application file for complete search history.

(56) References Cited

U.S. PATENT DOCUMENTS

2003/0179067 A1* 9/2003 Gamou ..... H01F 27/2804 336/223

* cited by examiner

*Primary Examiner* — Ronald Hinson
(74) *Attorney, Agent, or Firm* — Patterson Intellectual Property Law, P.C.; Gary L. Montle; Jerry Turner Sewell

(57) ABSTRACT

A low profile inductive apparatus is provided via one or more traces in a printed circuit board, the one or more traces defining inductive winding turns about an aperture, and a core comprising an elongate core member configured for positioning through the aperture of the circuit board. The core may be press fit with respect to the printed circuit board, or alternatively the elongate core member and the aperture may be reciprocally threaded. In an embodiment, core flanges may be provided on opposing sides of the printed circuit board, with the elongate core member connected between the core flanges and extending through the aperture. The number of inductive winding turns relates to a required inductance of the inductor when the elongate core member is positioned through the aperture, and a width and thickness of the windings corresponds to a required carrying capacity of the inductor.

16 Claims, 13 Drawing Sheets

LOW PROFILE INDUCTOR

CROSS-REFERENCES TO RELATED APPLICATIONS

This application claims benefit of U.S. Provisional Patent Application No. 62/383,827, filed on Sep. 6, 2016, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

Generally stated, the present invention relates to inductive elements for disposal on a printed circuit board. More particularly, the present invention relates to a low profile inductor using a PCB winding array and a press fit core extending there through.

An inductive element or apparatus, which may take multiple forms but is referred to herein simply as an inductor, may be a conductor which is arranged so as to store energy in a magnetic field adjacent to the conductor when electric current is flowing there through. Inductors are typically arranged with coil- or helix-shaped conductive windings having one or more turns to concentrate the magnetic flux induced by the electric current in a central area, typically referred to as the inductor core. The inductance of the inductor may be increased by increasing the number of turns of the conductive windings, and/or by positioning ferromagnetic material within the coil (i.e., as the inductor core). Typical inductive apparatus can occupy a substantial amount of space relative to other electrical components, and may also be prohibitively expensive in many situations.

FIG. 1 illustrates an inductor 15 as conventionally known in the art for application with respect to a printed circuit board. FIG. 1 particularly illustrates a bobbin core inductor 15, although other examples (not shown) may include rod core inductors and chip inductors. Such inductors 15 may typically be attached directly to a printed circuit board via pins, connectors or the like, and may be too large or may otherwise include at least one dimension that is too great to serve a desired purpose. Also, such inductors 15 may also be too costly or difficult to produce.

As such, it would be desirable to provide an inductor with a relatively low cost, which is easy to produce, and present a low profile alternative to typical inductors 15.

BRIEF SUMMARY OF THE INVENTION

In accordance with a particular embodiment as disclosed herein, a low profile inductive apparatus is provided via one or more traces in a printed circuit board, the one or more traces defining inductive winding turns about an aperture, and a core comprising an elongate core member configured for positioning through the aperture of the circuit board. The number of inductive winding turns may relate to a required inductance of the inductor when the elongate core member is positioned through the aperture, and a width and thickness of the windings corresponds to a required carrying capacity of the inductor.

In one exemplary aspect of the aforementioned embodiment, the core may be press fit with respect to the printed circuit board, or alternatively the elongate core member and the aperture may be reciprocally threaded.

In another exemplary aspect of the aforementioned embodiment, core flanges may be provided on opposing sides of the printed circuit board, with the elongate core member connected between the core flanges and extending through the aperture.

In another exemplary aspect of the aforementioned embodiment, the aperture defined in the printed circuit board may include a hole perimeter and a hole axis, and the hole perimeter may include at least one hole perimeter protrusion extending toward the hole axis.

DETAILED DESCRIPTION OF THE INVENTION

Figure 1:
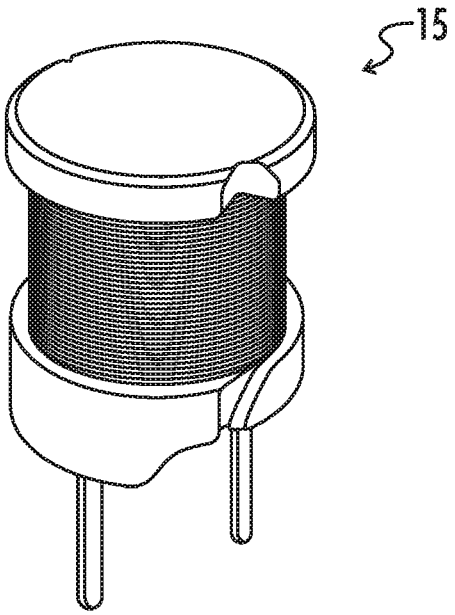
FIG. 1 is a perspective view of a prior art inductor, particularly a bobbin core inductor.

Referring generally to FIGS. 2-13, various exemplary embodiments of an invention may now be described in detail. Where the figures may illustrate embodiments sharing various common elements and features with other embodiments, similar elements and features are given the same reference numerals and redundant description thereof may be omitted below. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements, and/or states. Thus, such conditional language is not generally intended to imply that features, elements, and/or states are in any way required for one or more embodiments.

Figure 2:
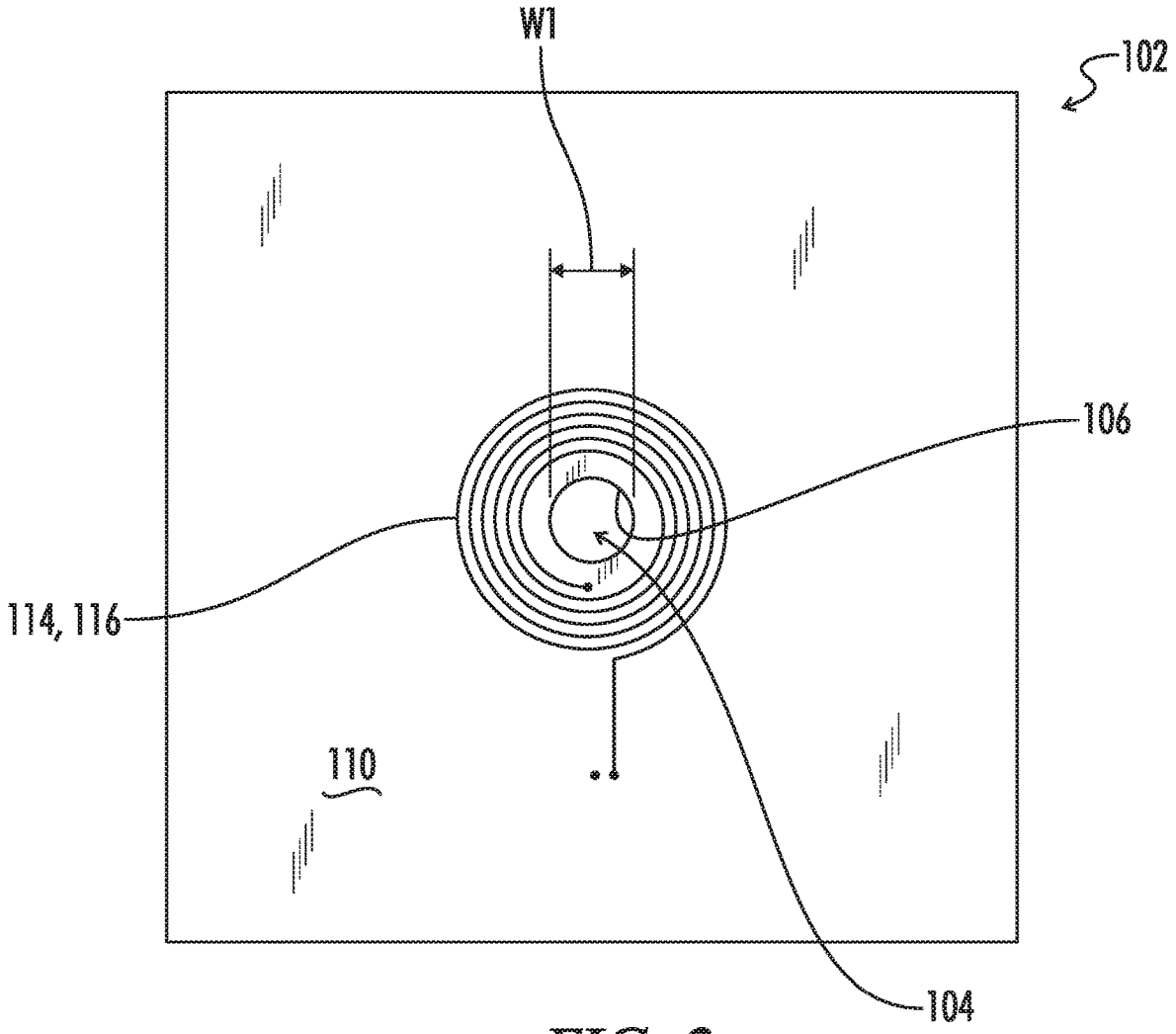
FIG. 2 is a front elevation view of a circuit board according to an embodiment of the current disclosure.
Figure 3:
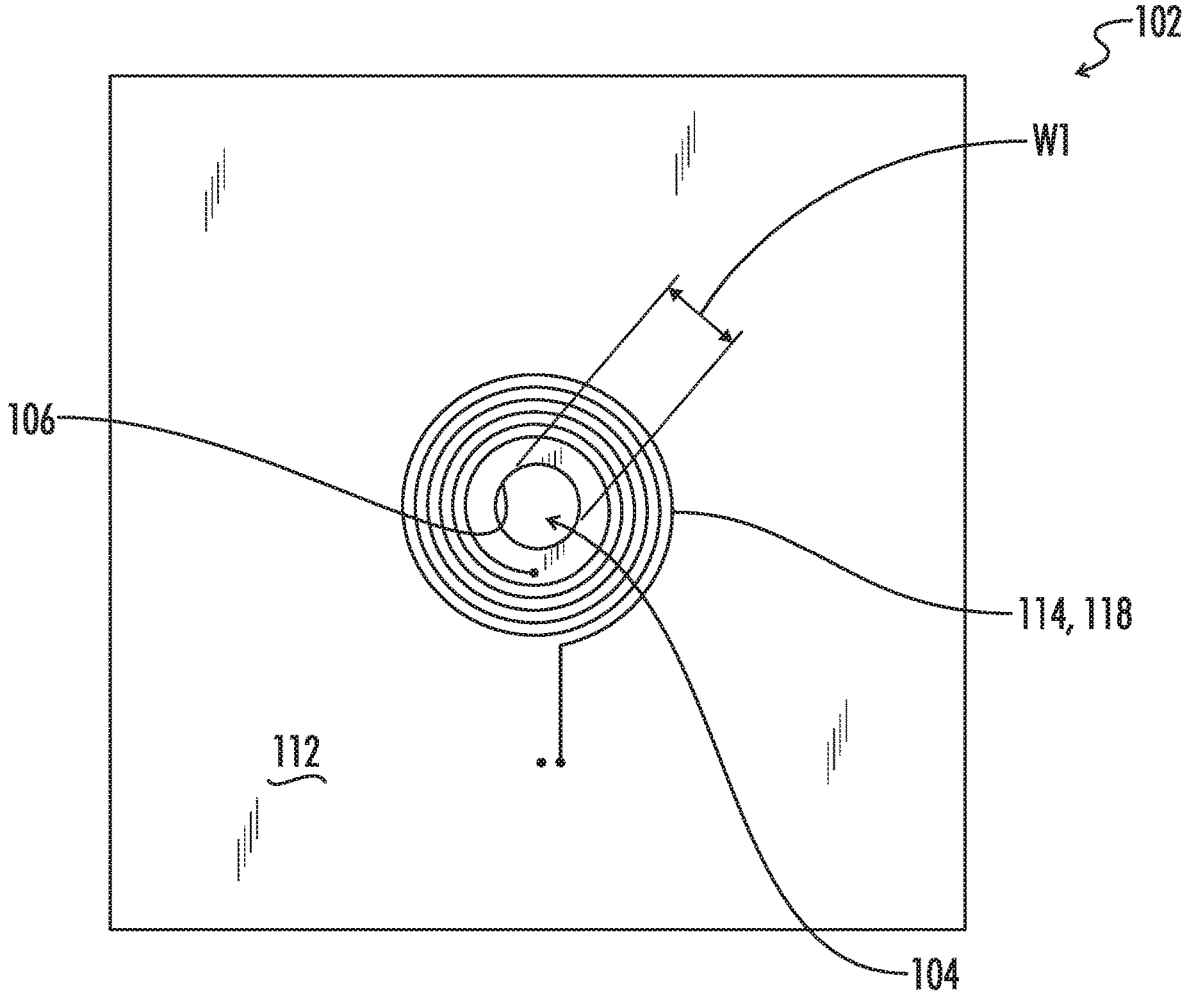
FIG. 3 is a rear elevation view of the circuit board of FIG. 2.

A first embodiment of an inductor 100 according to the present disclosure, as shown particularly in FIGS. 2 and 3, may include one or more winding turns defined by traces in a printed circuit board (PCB) 102. The circuit board 102 may include an aperture or hole 104 defined therein. The circuit board 102 may have a hole perimeter 106 defining the hole 104. The hole 104 may be any appropriate shape or size, and some embodiments of the hole 104 may include a circular hole, a triangular hole, a rectangular hole, and the like. In embodiments of the inductor 100 including a hole 104 that is circular, the hole perimeter 106 may be a circular hole perimeter. Similarly, the hole perimeter 106 may be any corresponding appropriate shape in relation to the hole 104. The hole 104 may also include a minimum hole width W1 and a hole axis A1.

Figure 7:
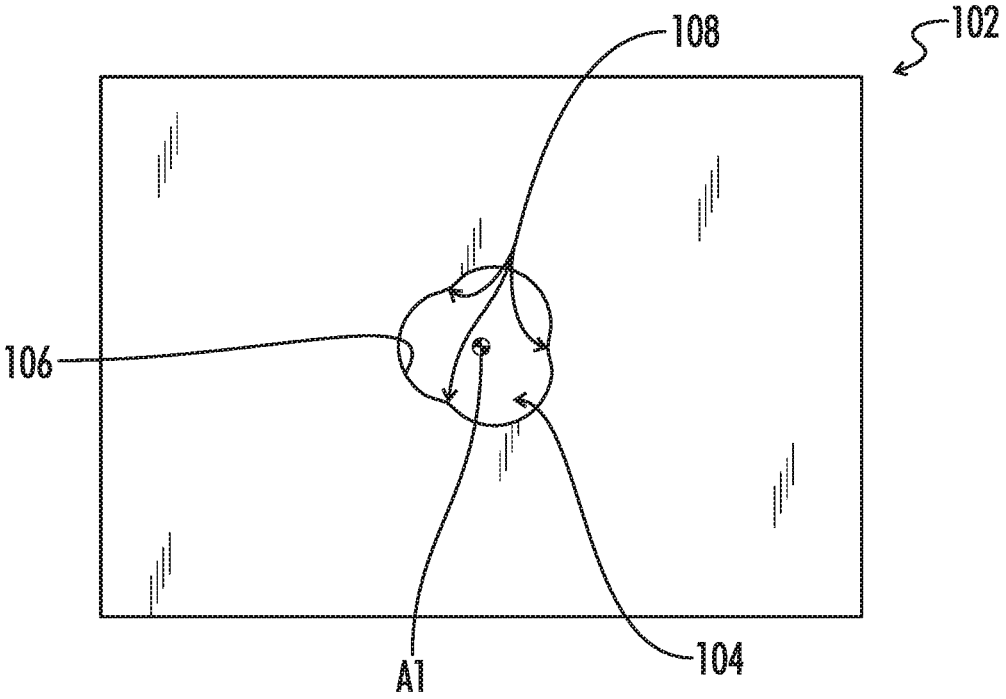
FIG. 7 is a schematic front elevation view of a circuit board according to an embodiment of the current disclosure.
Figure 8:
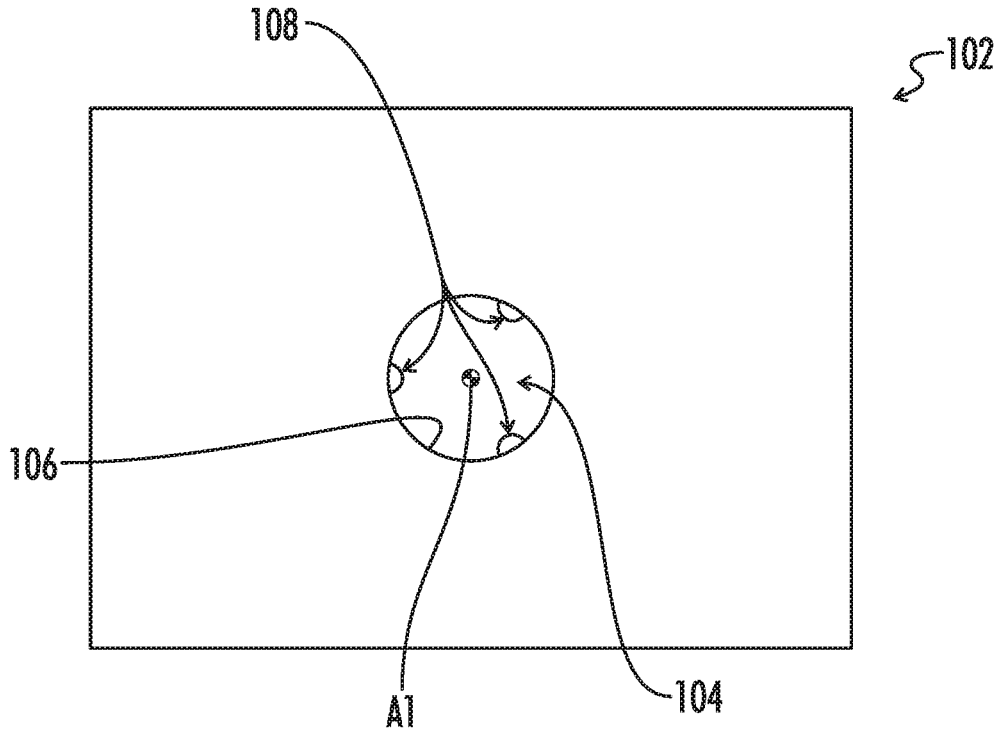
FIG. 8 is a schematic front elevation view of a circuit board according to an embodiment of the current disclosure.

With regard to FIGS. 7 and 8, the hole perimeter 106 may further include at least one hole perimeter protrusion 108 that extends toward the hole axis A1. In embodiments of the circuit board 102 having a hole 104 that is circular, the hole perimeter 106 may include a circle interrupted by the at least one hole perimeter protrusion 108. Of course, the hole 104 in all embodiments may be made by any appropriate method and with the use of any appropriate tools. Non-limiting examples may include forming the circuit board 102 with the hole 104 already in place, boring a hole into the circuit board, punching a hole into the circuit board, and the like. The printed circuit board substrate may for example be formed with a perforated region to facilitate punching of the hole and defining the inductor aperture thereby.

Particularly, FIG. 7 may be an embodiment that may lend itself to the boring process, allowing a user to perform three plunges with a tool such as a drill in order to form the shown hole 104.

The embodiment in FIG. 8 may alternatively be an appropriate example of a hole 104 that could be formed by punching the hole into the circuit board 102.

Returning now to FIGS. 2, 3, 5, and 6, the circuit board 102 may further include a first circuit board side 110 and a second circuit board side 112 opposite the first circuit board side. A central circuit board plane P1 may be disposed between the first circuit board side 110 and the second circuit board side 112. The first circuit board side 110 may be defined as an outer face of the circuit board 102 on a first side of the central circuit board plane P1. In the broadest definition, however, the first circuit board side 110 simply includes any portion of the circuit board 102 that is disposed anywhere along a first direction D1 from the central circuit board plane P1. Similarly, the second circuit board side 112 may be defined as an outer face of the circuit board 102 on a second side of the central circuit board plane P1. In the broadest definition, however, the second circuit board side 112 simply includes any portion of the circuit board 102 that is disposed anywhere along a second direction D2 from the central circuit board plane P1.

With reference particularly to FIGS. 2 and 3, the circuit board 102 may also include at least one winding 114 disposed about the hole 104 along a majority of the hole perimeter 106. In many embodiments, the winding 114 may be disposed about the hole 104 along the entire hole perimeter 106 in a spaced-apart relationship with the hole perimeter. As shown in FIGS. 2 and 3, the at least one winding 114 may include several turns. Of course, the winding 114 may include only one turn in some embodiments. The number of turns of the winding 114 may be selected according to a desired inductance of the inductor 100.

In embodiments of the circuit board 102, the at least one winding 114 may include one or more traces of the PCB. In many embodiments, the at least one winding 114 may include a first winding 116 disposed on the first circuit board side 110 and a second winding 118 disposed on the second circuit board side 112. Some embodiments of the circuit board 102 may include the first winding 116 electrically connected to the second winding 118. Further embodiments may include the first winding 116 having a first number of turns and the second winding 118 having a second number of turns. The first number of turns may be equal to the second number of turns, or they may be different depending on the application.

In embodiments of the circuit board 102 having a hole 104 that is circular, the at least one winding 114 may run about the hole substantially or exactly parallel to the hole perimeter 106. Similarly, other aperture geometries may include the at least one winding 114 running about the hole perimeter 106 at an approximately equal spacing. As shown in FIGS. 2 and 3, however, the winding 114 may coil about the hole 104 and move away from the hole as the winding 114 travels through the turns. In many embodiments, the at least one winding 114 may run about the hole 104 parallel to the central circuit board plane P1. The width and thickness of the windings 114 (traces) may be any appropriate dimensions and may be determined based on the desired current carrying capability of the inductor.

Figure 4:
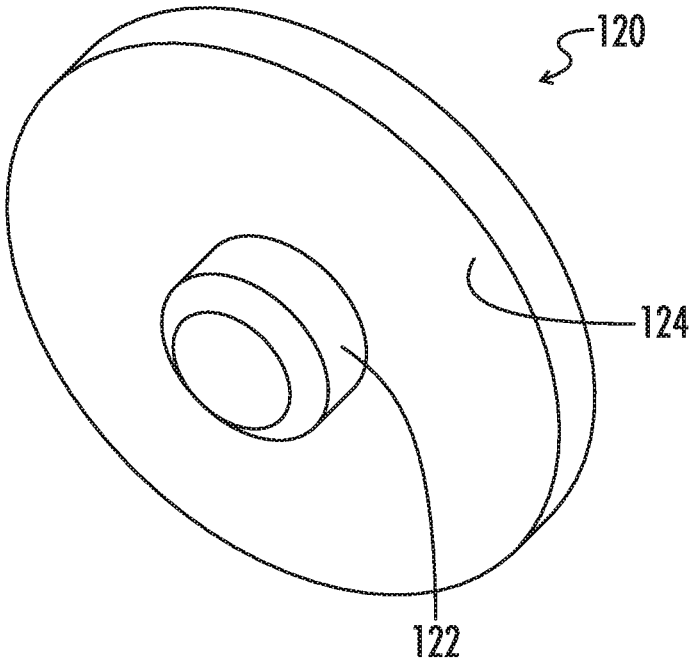
FIG. 4 is a perspective view of a core according to an embodiment of the current disclosure.
Figure 5:
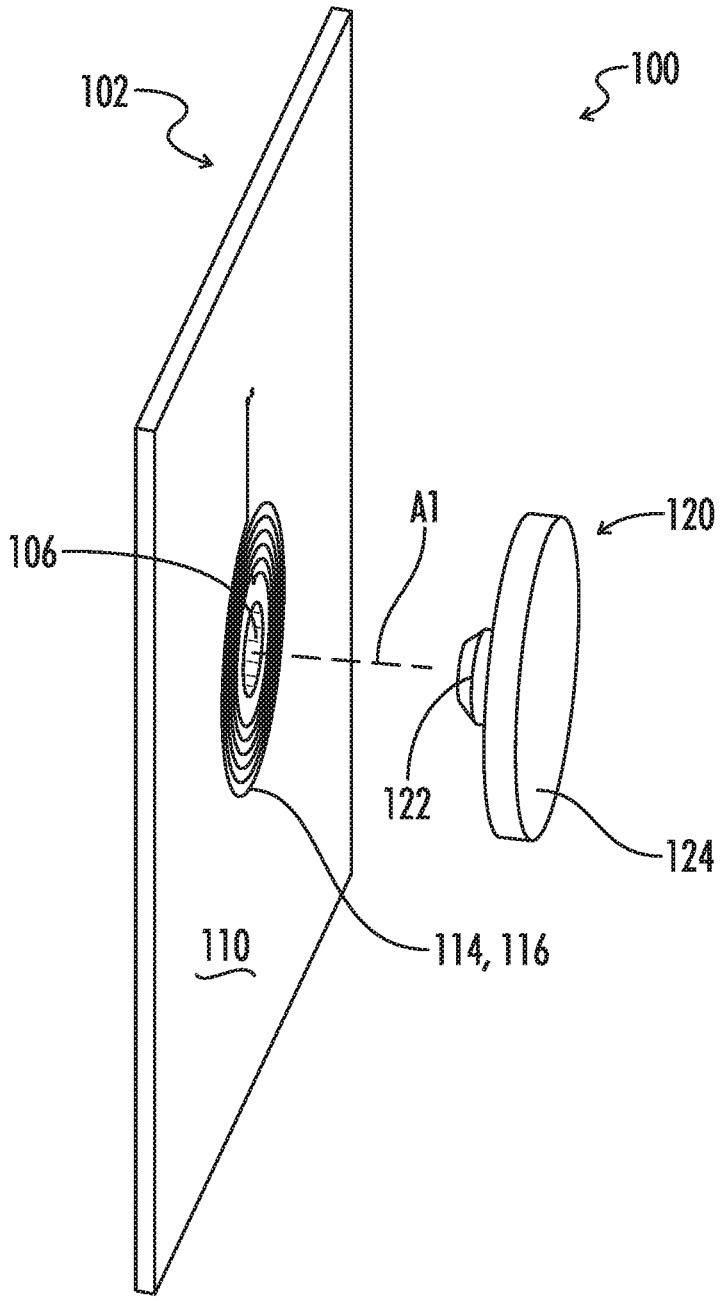
FIG. 5 is a perspective view of an inductor according to an embodiment of the current disclosure with the core exploded from the circuit board.
Figure 6:
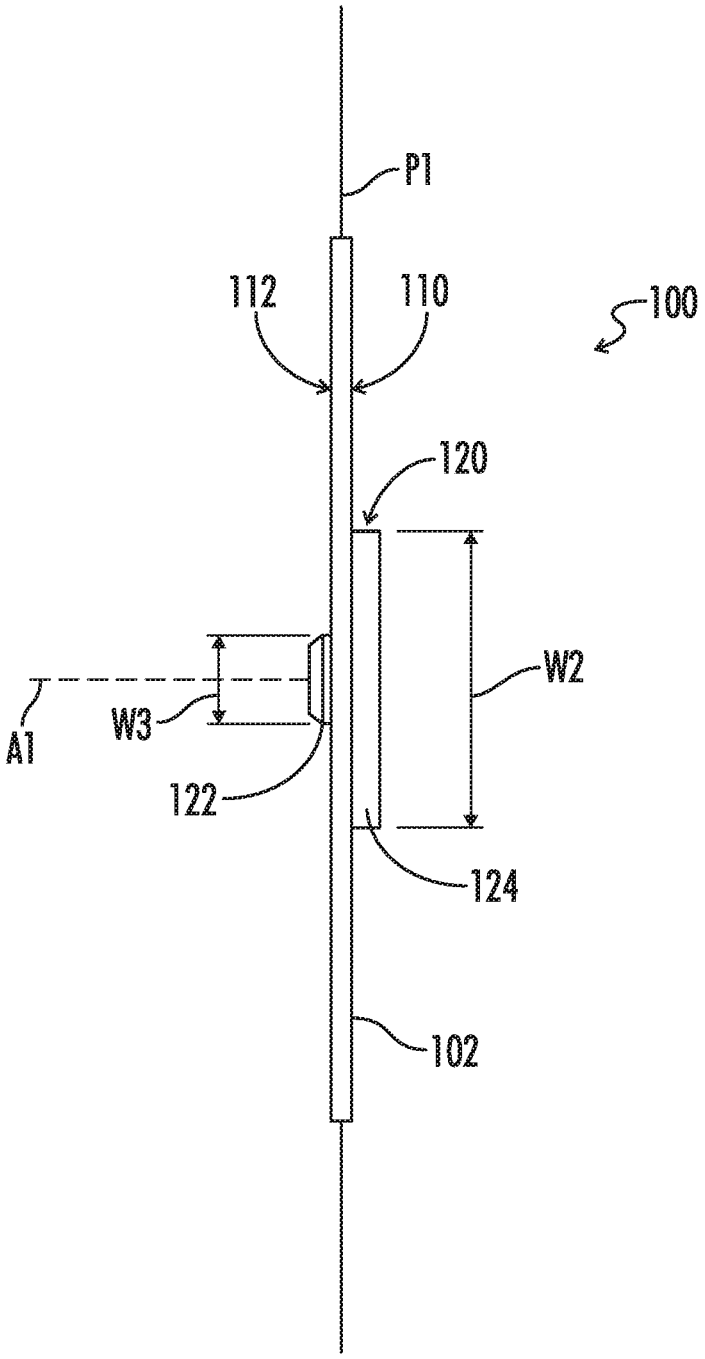
FIG. 6 is a side elevation view of the inductor of FIG. 5.

Turning now to FIGS. 4-6, the inductor 100 may further include a core 120. The core 120 may be made from any appropriate material including, but not limited to, ferrite, silicon steel, iron powder, alloys of various types, molybdenum permalloy powder, sendust, and the like. The core 120 may include an elongate core member 122. The elongate core member 122 may be disposed in the hole 104 of the circuit board 102 when the inductor 100 is assembled. In many embodiments, the core 120 may further include a core flange portion 124 connected to the elongate core member 122. The core flange portion 124 may have a minimum width W2 that is wider than the hole of the circuit board 102.

Stated another way, the minimum width W2 of the core flange portion 124 may be greater than the minimum hole width W1 of the hole 104 defined in the circuit board 102. In some embodiments, the minimum width W2 of the core flange portion 124 may be at least twice as great as the minimum hole width W1. In still further embodiments, the minimum width W2 of the core flange portion 124 may be at least three times as great as the minimum hole width W1. The core flange portion 124 may also be any appropriate shape including, but not limited to, a circular prism, a rectangular prism, a triangular prism, a triangular pyramid, and the like. The elongate core member 122 may further include a maximum member width W3 that is greater than the minimum hole width W1.

In many embodiments, the core 120 and the circuit board 102 are connected by an interference fit, such as for example a press fit, between the elongate core member 122 and the circuit board in the hole 104.

Figure 12:
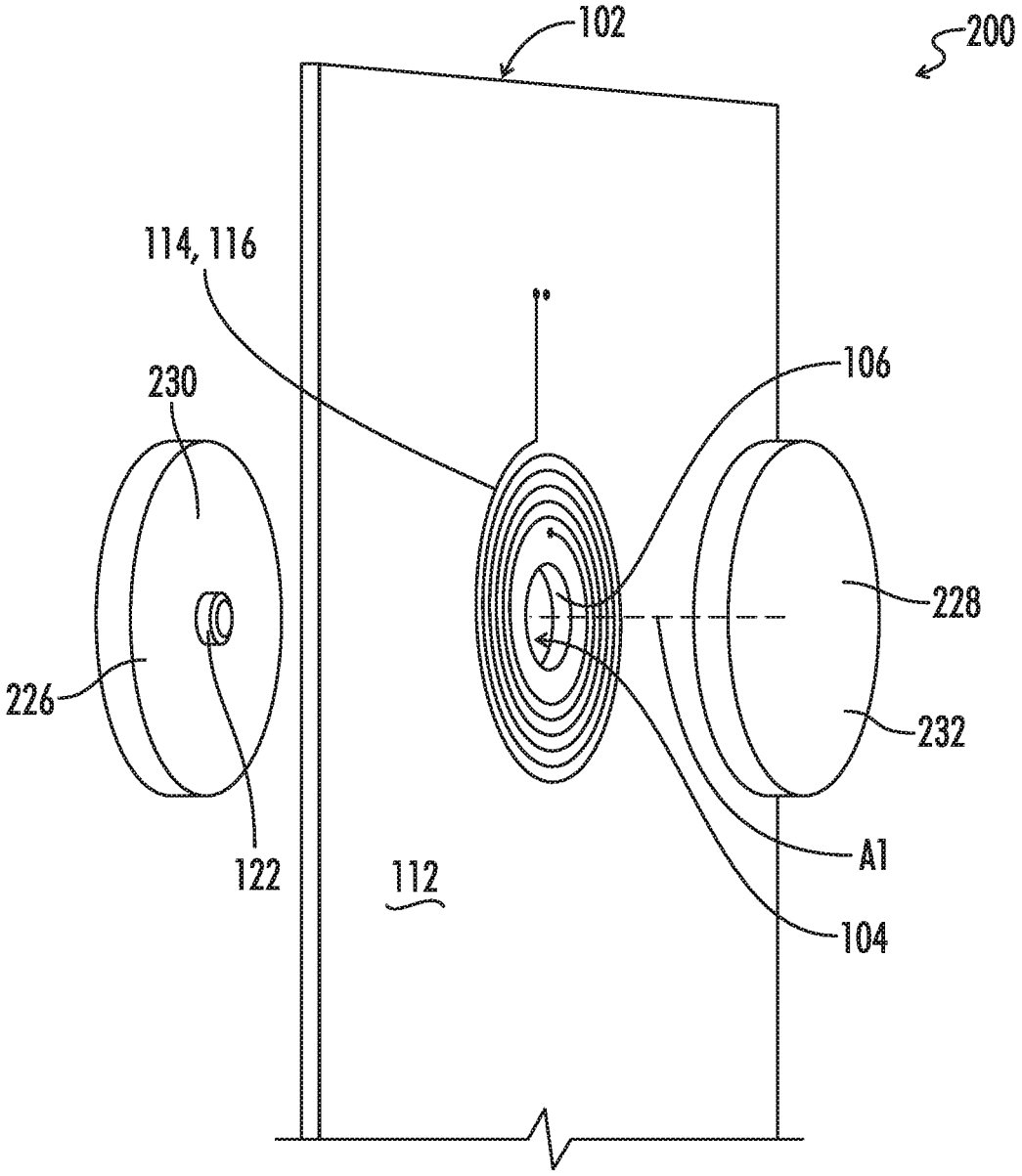
FIG. 12 is a perspective view of an inductor according to an embodiment of the current disclosure with the first core body and the second core body exploded from the circuit board.
Figure 13:
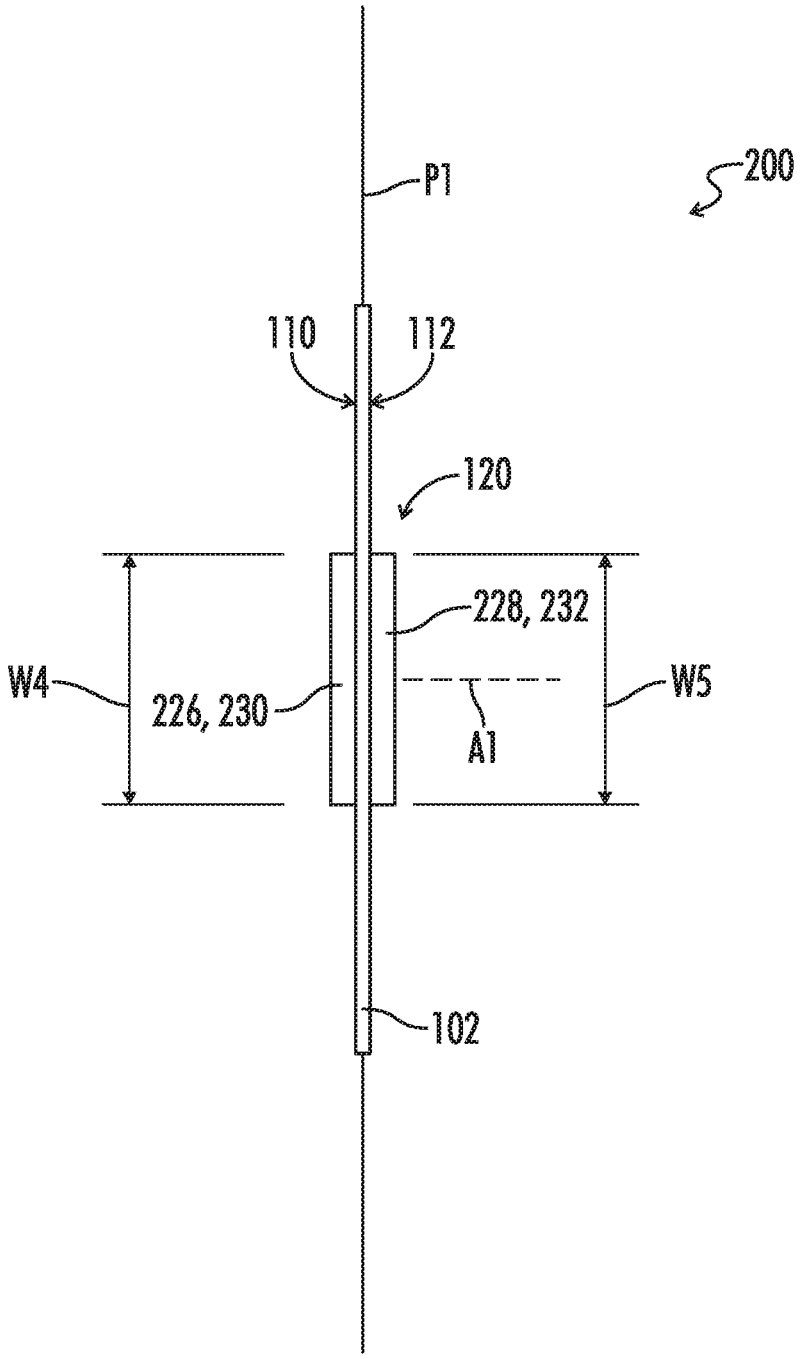
FIG. 13 is a side elevation view of the inductor of FIG. 12.

Turning now to FIGS. 12 and 13, another embodiment of an inductor 200 is shown. The inductor 200 may include a core 120 having a first core body 226 and a second core body 228. When the inductor 200 is assembled, the first core body 226 may be disposed on the first circuit board side 110 of the central circuit board plane P1. The second core body 228 may be disposed on the second circuit board side 112 of the central circuit board plane P1. The elongate core member 122 may connect the first core body 226 and the second core body 228.

In some embodiments, the first core body 226 may include a first core body flange portion 230 connected to the elongate core member 122. The first core body flange portion 230 may have a minimum width W4 that is wider than the hole 104 of the circuit board 102. The first core body flange portion 230 may be any appropriate shape and dimension as stated above with regard to the core flange portion 124.

Figure 9:
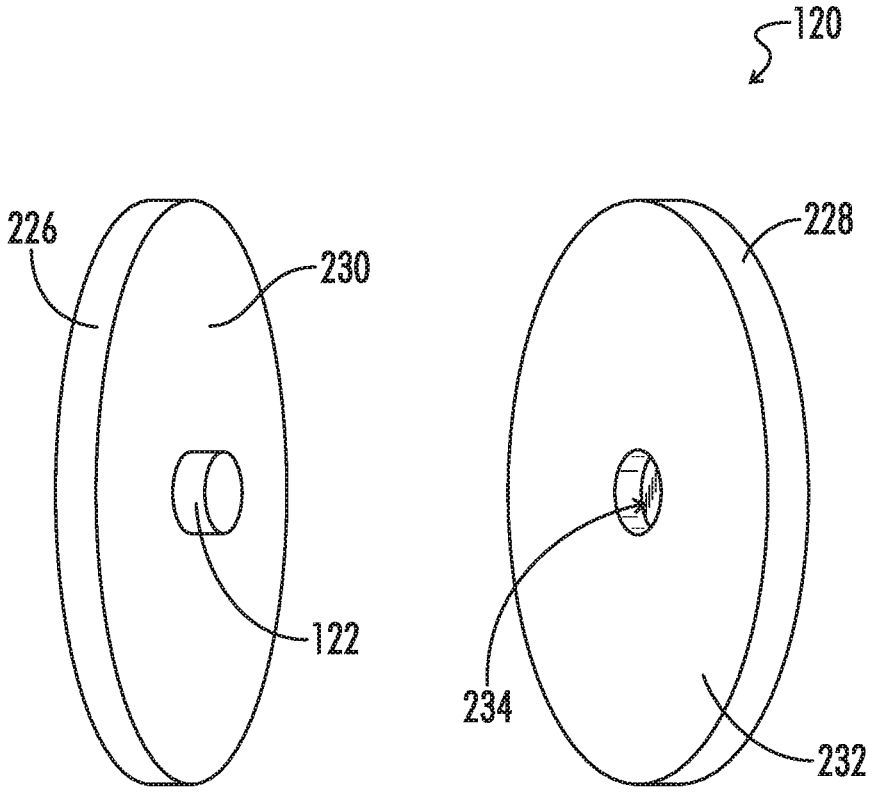
FIG. 9 is a perspective view of a core according to an embodiment of the current disclosure with a first core body disconnected from a second core body.
Figure 10:
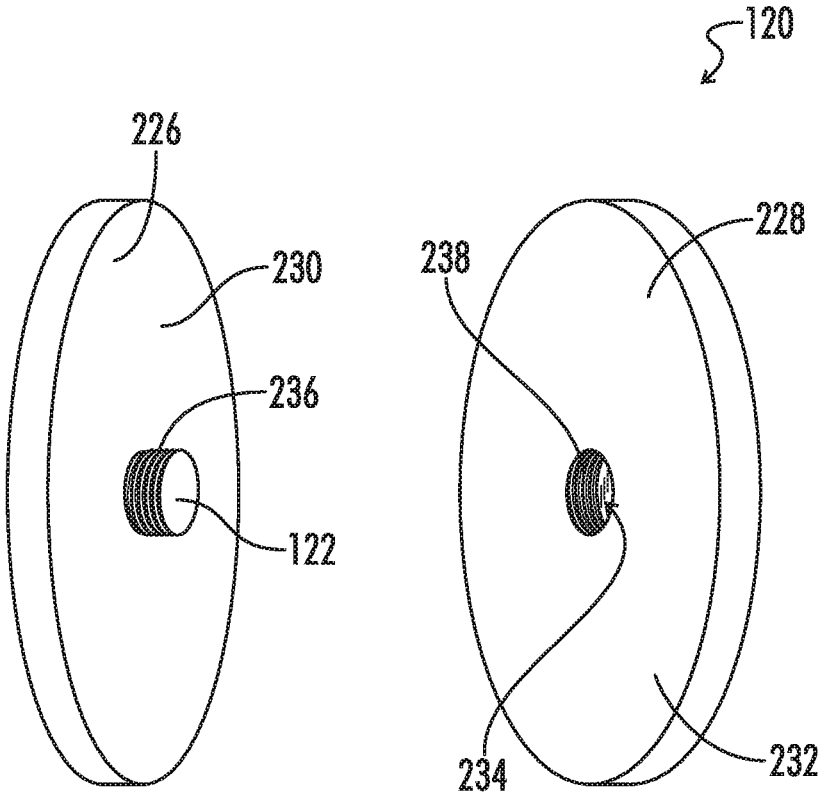
FIG. 10 is a perspective view of a core according to an embodiment of the current disclosure with a first core body disconnected from a second core body.
Figure 11:
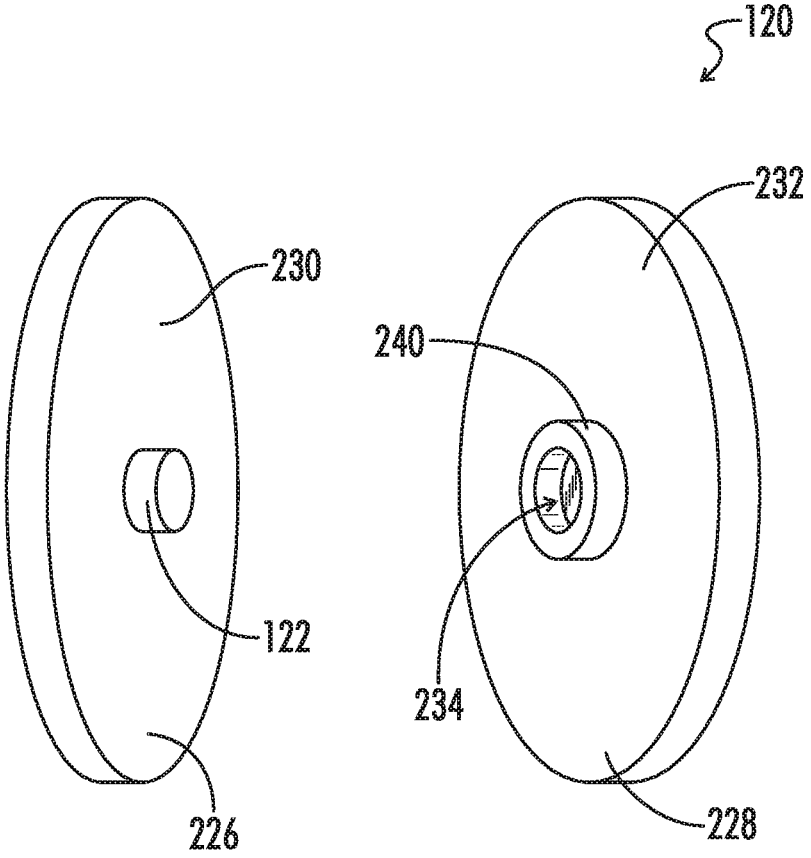
FIG. 11 is a perspective view of a core according to an embodiment of the current disclosure with a first core body disconnected from a second core body.

As shown particularly in FIGS. 9-11, the second core body 228 may include a second core body flange portion 232. The second core body flange portion 232 may include a minimum width W5 that is wider than the hole of the circuit board. The second core body flange portion 232 may be any appropriate shape and dimension as stated above with regard to the core flange portion 124. The second core body 228 may further include a second core body cavity 234 defined therein. The elongate core member 122 may be received in the second core body cavity 234. In some embodiments, the second core body 228 may include only the flange portion 232 shaped as a disc or other appropriate prism with a cavity 234 defined therein on one of the faces of the flange portion. Many embodiments may include the first core body 226 and the second core body 228 connected to each other by an interference fit between the elongate core member 122 and the second core body in the second core body cavity 234. Stated another way, the elongate core member 122 may be press fit into the second core body cavity 234.

In some embodiments, the elongate core member 122 may threadingly engage the second core body 228 in the second core body cavity 234. Such embodiments may include threads 236 defined on the outer surface of the elongate core member 122 and corresponding threads 238 defined on the perimeter of the second core body cavity 234.

In at least one embodiment, the second core body 228 may include a second elongate core member 240 connected to the second core body flange portion 232. In such embodiments, the second core body cavity 234 may be defined in the second elongate core member 240. Other configurations with a connection between the first core body 226 and the second core body 228 are also contemplated herein including, but not limited to, pin and channel configurations, using one or more adhesives, welding of any type, and the like.

Thus, although there have been described particular embodiments of the present invention of a new and useful invention, it is not intended that such references be construed as limitations upon the scope thereof, except as set forth in the following claims.

What is claimed is:

1. A low profile inductive apparatus, comprising:

one or more traces in a printed circuit board, the one or more traces defining inductive winding turns about an aperture, the aperture having a first shape, the first shape defined by at least a first dimension; and a core comprising an elongate core member configured for positioning through the aperture of the circuit board, the elongate core member having a second shape, the second shape defined by at least a second dimension, the second dimension slightly greater than the first dimension, wherein the core and the printed circuit board are connected by an interference fit between the elongate core member and the printed circuit board in the aperture caused by the second dimension being slightly greater than the first dimension, wherein a number of the inductive winding turns corresponds to an inductance of the inductor when the elongate core member is positioned through the aperture.

2. The apparatus of claim 1, the core further comprising a core flange portion connected to the elongate core member, the core flange portion having a minimum width that is wider than the aperture of the printed circuit board.

3. The apparatus of claim 1, wherein the first dimension is a width of the first shape of the aperture and the second dimension is a width of the second shape of the elongate core member.

4. The apparatus of claim 1, wherein:

the first shape of the aperture and the second shape of the elongated core member are circular; and the first dimension is a diameter of the first shape of the aperture and the second dimension is a diameter of the second shape of the elongate core member.

5. The apparatus of claim 1, wherein the printed circuit board comprises:

a first circuit board side and an opposing second circuit board side; and a central circuit board plane disposed between the first circuit board side and the second circuit board side; and at least a first winding disposed on the first circuit board side.

6. The apparatus of claim 5, further comprising at least a second winding disposed on the second circuit board side.

7. The apparatus of claim 6, wherein the first winding and the second winding are electrically connected.

8. The apparatus of claim 7, wherein a number of turns in the first winding is equal to a number of turns in the second winding.

9. The apparatus of claim 1, wherein:

the aperture defined in the printed circuit board includes a hole perimeter and a hole axis; and the hole perimeter includes at least one hole perimeter protrusion extending toward the hole axis.

10. The apparatus of claim 9, wherein the hole perimeter includes a circle interrupted by the at least one hole perimeter protrusion.

11. The apparatus of claim 1, wherein the core further comprises:

a first core body disposed on a first circuit board side;

a second core body disposed on a second circuit board side opposite the first circuit board side; and the elongate core member connecting the first core body and the second core body.

12. The apparatus of claim 11, wherein:

the first core body includes a first core body flange portion connected to the elongate core member, the first core body flange portion having a minimum width that is wider than the aperture of the printed circuit board; and the second core body includes a second core body flange portion having a minimum width that is wider than the aperture of the printed circuit board.

13. The apparatus of claim 12, wherein:

the second core body further includes a second core body cavity defined therein, the elongate core member configured to be received in the second core body cavity.

14. The apparatus of claim 13, wherein:

the first core body and the second core body are connected by an interference fit between the elongate core member and the second core body in the second core body cavity.

15. The apparatus of claim 13, wherein:

the elongate core member threadingly engages the second core body in the second core body cavity.

16. The apparatus of claim 13, wherein:

the second core body includes a second elongate core member connected to the second core body flange portion; and the second core body cavity is defined in the second elongate core member.

* * * * *